US005375292A

United States Patent [19]

Bailey

[11] Patent Number: 5,375,292

[45] Date of Patent: Dec. 27, 1994

[54] SYSTEM AND METHOD FOR VACUUM EXTRACTION OF FOREIGN MATERIALS

[75] Inventor: James C. Bailey, Norristown, Pa.

[73] Assignee: All Pro Services Inc., Norristown, Pa.

[21] Appl. No.: 159,810

[22] Filed: Dec. 1, 1993

[51] Int. Cl.[5] ..... A47L 9/00

[52] U.S. Cl. ..... 15/321; 15/422.2

[58] Field of Search ..... 15/422.2, 353, 321

[56] References Cited

U.S. PATENT DOCUMENTS 4,137,599 2/1979 Steyer ..... 15/321 X
4,231,133 11/1980 Probost ..... 15/422.2
4,628,566 12/1986 Klapperich ..... 15/422.2
5,054,157 10/1991 Werner et al. ..... 15/422.2 X
5,210,902 5/1993 Lee et al. ..... 15/321

*Primary Examiner*—Chris K. Moore
*Attorney, Agent, or Firm*—Duane, Morris & Heckscher

[57] ABSTRACT

The suction capabilities of a original-equipment (O.E.) extractor providing inadequate suction are enhanced, thereby avoiding the need to purchase another and more expensive extractor, by the addition to it of a vacuum booster. The booster contains its own blower and an electric motor for driving the blower, and the inlet of the blower is connected to the outlet of the O.E. extractor. The booster is conveniently mounted to the O.E. extractor by means of suction cups. A doubling of the suction level can be achieved in this manner.

5 Claims, 2 Drawing Sheets

SYSTEM AND METHOD FOR VACUUM EXTRACTION OF FOREIGN MATERIALS

FIELD OF THE INVENTION

This invention relates to systems and methods for the vacuum extraction of liquid and/or solid foreign materials from objects such as carpets, rugs, floors, etc; it relates particularly to apparatus for increasing the levels of vacuum producible in a steam cleaner system.

BACKGROUND OF THE INVENTION

Systems and methods are know in which an electric motor rotates a blower or fan blade to produce a partial vacuum in an inlet line secured to a vacuum hose, the distal end of the hose having a fitting designed to be used in attracting and aspirating material which is to be picked up and collected in the collection chamber of an extractor. While the material to be picked up may be in solid form, it is typically a liquid carrying foreign matter, such as is left in place after the steam cleaning of a carpet or other flooring material. For convenience, the vacuuming device is referred to herein as a vacuum-type liquid extractor, since it may be used to extract cleaning liquid from a recently steam-cleaned carpet, for example, although its principle may be applied as well in a vacuum cleaner of solids only.

Unfortunately, after such a liquid extractor is purchased it may be found that it does not provide sufficient suction or vacuum level to do the job for which it was intended, and it is then necessary to purchase a new, more powerful liquid extractor, at considerable additional expense. For example, after application of liquid or steam to a carpet, the extractor may not be strong enough to remove all liquid and to leave the carpet substantially dry, as desired.

A principal object of this invention is therefore to provide a method and system for overcoming this problem of insufficient suction, without requiring purchase of another, and even more expensive, liquid extractor.

SUMMARY OF THE INVENTION

In accordance with the invention, an auxiliary add-on vacuum booster is provided and attached to the exterior of the original-equipment liquid extractor, to increase the vacuum produced to the level desired or necessary for accomplishing the intended work.

Preferably the booster is a unit readily attachable to the exterior of the original-equipment extractor, and contains an electric motor and an air-moving blade rotatable by the motor to produce the desired additional vacuum. The inlet of the booster communicates with the outlet of the original-equipment extractor, and the outlet of the booster discharges the air to atmosphere, so that when the booster and original-equipment extractor are run simultaneously, their effects combine additively to produce the desired augmented vacuum level at the air inlet end of the original-equipment extractor.

In one embodiment, the booster may have an outer casing, on which are mounted an on-off power switch for the booster and an AC power supply plug for supplying the booster motor with the necessary line power.

Preferably, the booster unit is provided with a set of vacuum cups mounted on its rear surface by fasteners, which cups can be urged against an adjacent vertical surface of the casing of the original-equipment extractor to mount the booster in place; a small amount of adhesive may be applied to at least some of the cups to assure their holding to the casing.

As an example, by use of this invention an original-equipment extractor normally producing 120" of water lift may produce twice that level of vacuum by use of the add-on booster, thus avoiding the need to purchase an additional higher-powered extractor.

BRIEF DESCRIPTION OF THE DRAWINGS

These and other objects and features of the invention will be more readily understood from a consideration of the following detailed description, taken with the accompanying drawings, in which.

DETAILED DESCRIPTION OF PREFERRED EMBODIMENTS

Figure 2:
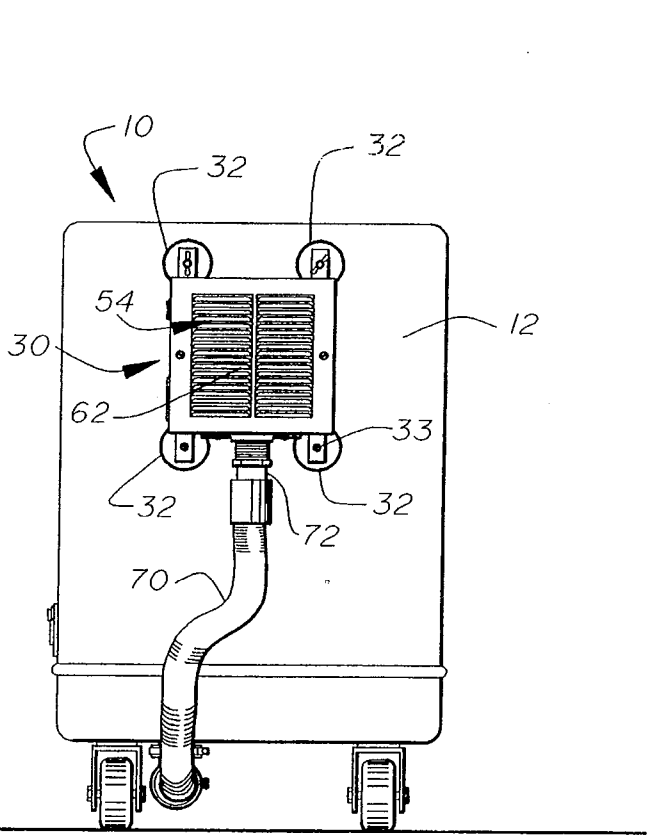
FIG. 2 is an end view taken along lines 2—2 of FIG. 1.
Figure 1:
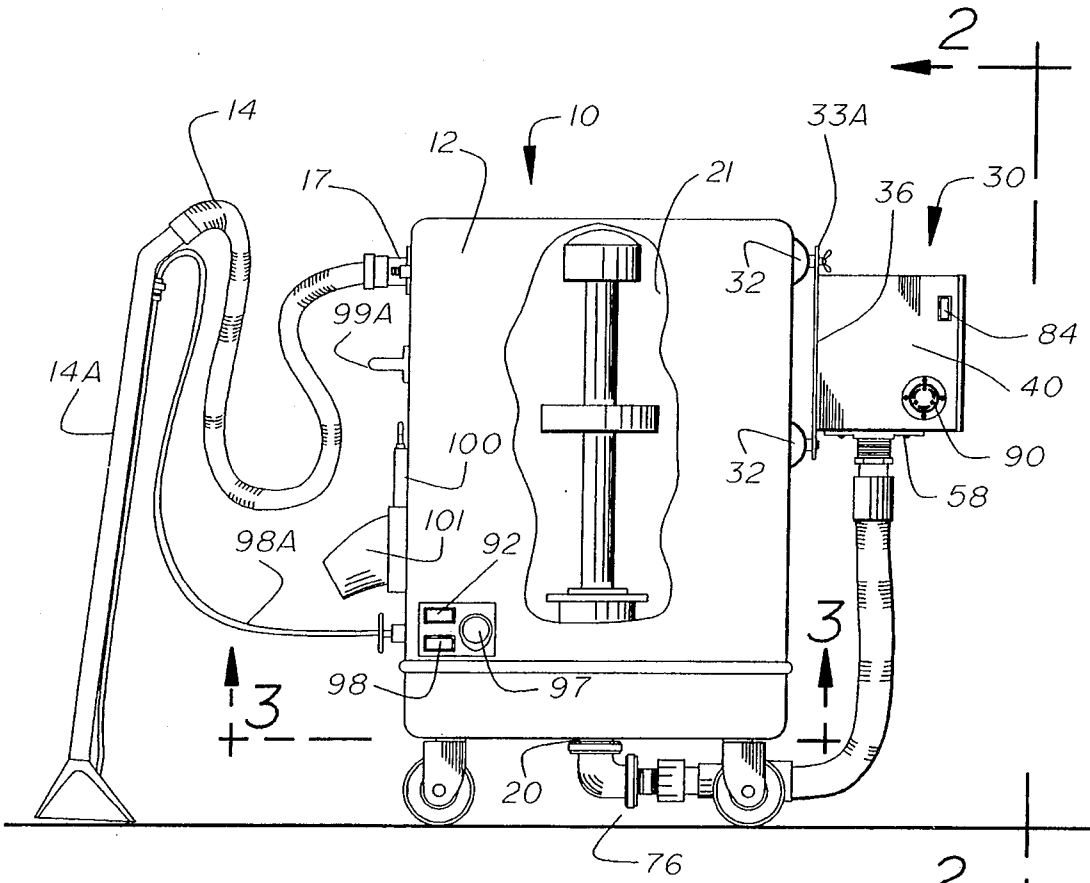
FIG. 1 is a side elevational view of an extractor system using the present invention.

Referring now to the preferred embodiment of the invention shown in the drawings by way of example only, there is shown a conventional original-equipment extractor 10 having an outer casing 12, a vacuum hose 14 and a wand 14A extending from it, and a fitting 16 at the end of the wand for application to the surface to be vacuumed, e.g. wet carpeting, so as to suck up moisture and any solids present and convey them into the extractor by way of air inlet 17, where they are collected in known manner. In such a standard extractor, the air is discharged through an outlet tube 20 mounted in the bottom of the unit and isolated from the main collector chamber 21. It is understood that within the casing 12 there are provided a usual air-moving blower and electric motor (not shown) for driving the blower in the direction to move air from the air inlet 17 of the extractor to the outlet tube 20. As pointed out above, it may be found by the user that the level of vacuum, or suction, produced by such conventional extractor is not high enough to suck up adequately the liquid present on a recently steam-cleaned carpet, for example, to provide the desired removal of liquid and dirt.

To overcome this difficulty in accordance with the invention, and without requiring purchase of a new, higher-powered extractor, there is provided a vacuum booster 30 secured to the rear of the extractor casing 12, in this case by means of suction cups 32, which are secured by screws such as 33 to respective flange tabs such as 33A constituting outboard ends of metal strips such as 36, in turn screwed to the bottom of booster outer casing 40.

Figure 4:
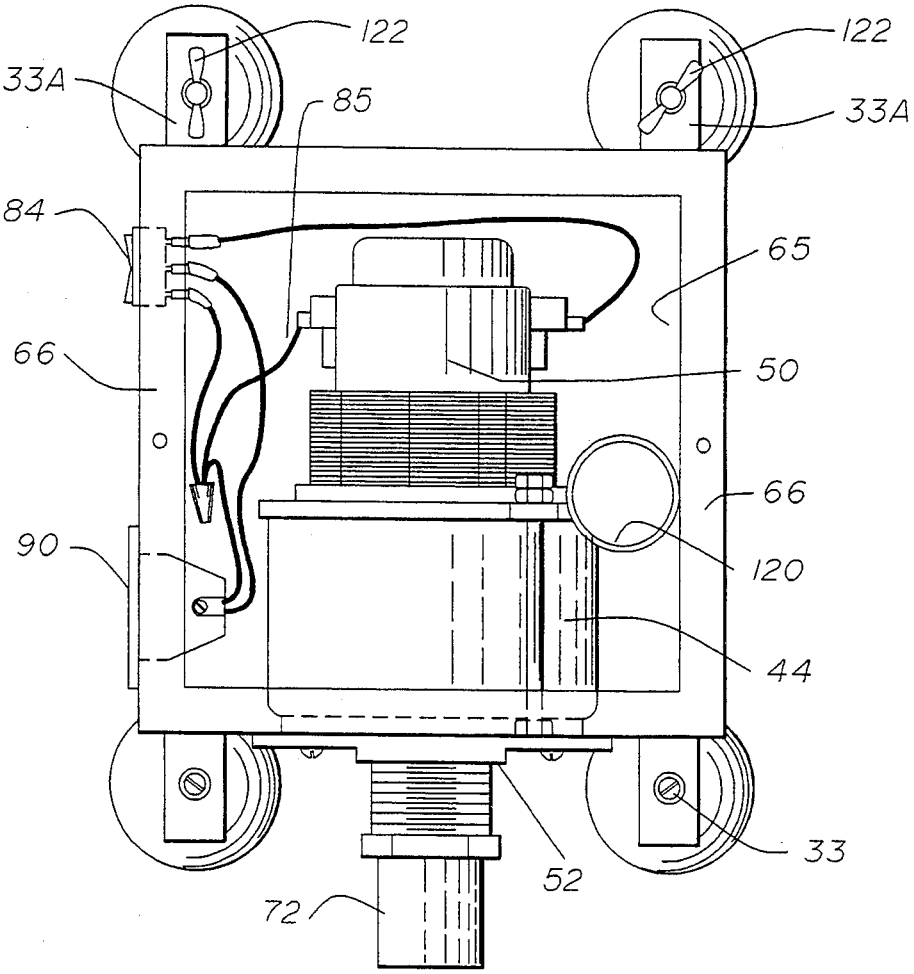
FIG. 4 is an enlarged view of the booster unit itself, with its outlet louver removed.
Figure 3:
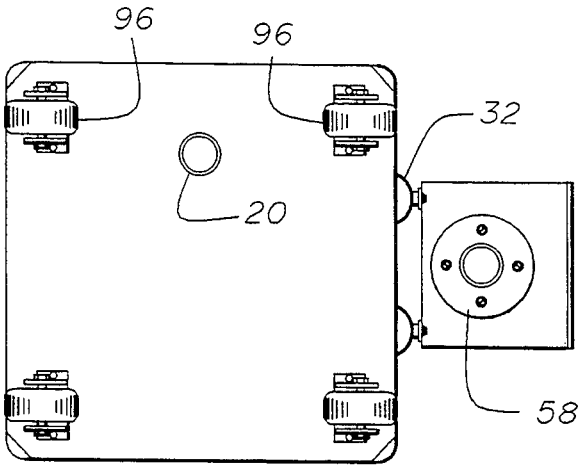
FIG. 3 is a bottom view of the system of FIG. 1, taken along lines 3—3.

The outer casing 40 of the booster (see FIG. 4) contains within it a blower 44 having a conventional blower blade which is rotatable by electric motor 50 in the direction to move air from the tubular booster inlet 52 in the bottom of the booster casing, to a louvered outlet 54 (FIG. 2) in an exposed free face of the booster casing. The inlet 52 is provided by a tube having a peripheral flange 58 which is screwed to the casing and communicates with the inlet 52 of blower 44. The louvered outlet 54 is formed by a metal louver 62 secured to the edges such as 66 of a rectangular opening 68, occupying most of the free front face of the booster casing.

A booster vacuum hose 70 is secured at one end, by quick connect-disconnect fitting 72, to the booster inlet; the opposite end of the booster hose is connected by fittings 76 to the outlet tube 20 of the original-equipment extractor.

A power switch 84 for the booster is mounted on the booster casing, and connected to the booster motor by wires 85; A-C power for the booster is supplied from any appropriate power source by way of the male connector receptacle 90, also mounted on a side of the booster casing.

In operation, when pick-up of liquid and/or dirt is desired, the vacuum-on switch 92 for the original-equipment extractor and switch 84 for the booster are both turned on, and the pick-up fitting 16 on the distal end of the vacuum wand 14A is applied to the surface from which liquid and/or solid foreign matter are to be removed. Air, with entrained liquid and/or solids, is thereby sucked through the extractor inlet 17 to the interior of the extractor 10, where the liquid and/or solid dirt are collected in the usual way. Cleansed air then passes from the original-equipment extractor, through the booster vacuum hose 70 to the booster blower 44, and thence through booster outlet tube 120 and booster louvered outlet 54 to atmosphere.

A typical booster, operating in this manner, has been found able to double the level of vacuum produced by the original-equipment extractor, for example from about 120" of water to about 240" of water, with a corresponding increase in ability of the combination to pick up and collect liquid and/or solid foreign matter.

To assure mounting of the booster on the casing, an adhesive may be applied between the two top suction cups and the original-equipment casing, and to aid in removing the booster, wing nuts 122 may be provided at least on the two upper fastening screws for the two upper cemented suction cups.

The particular type of extractor shown by way of example is mounted on casters such as 96 for easy mobility, and is provided with a power receptacle 97 for receiving a conventional AC power cord, an additional switch 98 for controlling the dispensing of the cleaning solution, a line 99 for delivering cleaning solution to fitting 16, and a handle 99A for assisting in the maneuvering of the extractor. A conventional drain valve assembly 100, 101, as well as a pressure gauge and flow-regulator valve for the cleaner solution may also be employed (not shown). Inside the extractor casing is the usual float, standpipe and filter apparatus (not shown in detail) for dispensing cleaning solution and collecting the aspirated liquid and dirt. It will be understood that many other types of extractors, or vacuum cleaners, may be used with the booster of the invention, and the conventional extractor shown is by way of example only.

Thus, while the invention has been described with particular reference to specific embodiments in the interest of complete definiteness, it will be understood that it may be embodied in a variety of forms diverse from those specifically shown and described, without departing from the spirit and scope of the invention.

What is claimed is:

1. Vacuum-type extractor apparatus, comprising:

an original-equipment vacuum-type extractor comprising an air inlet and means in said extractor operative by itself to develop a vacuum of a predetermined level at said air inlet; and an add-on vacuum booster mounted to the exterior of said extractor, said vacuum booster having an air outlet to atmosphere and an air inlet communicating with said air outlet of said extractor, said vacuum booster being operative to increase the vacuum produced at said air inlet of said extractor to a level in excess of said level produced by operation of said original-equipment extractor alone.

2. The apparatus of claim 1, wherein said vacuum booster comprises an electrically rotatable air-moving blade.

3. The apparatus of claim 1, wherein said vacuum booster comprises an electrical motor and a blade rotatable by said motor in the direction to augment the vacuum produced by said original-equipment extractor acting alone.

4. The apparatus of claim 1, wherein said vacuum booster comprises an outer case and suction cups mounted thereon to facilitate mounting of said booster on the exterior of said extractor.

5. The method of augmenting the level of vacuum available at the air inlet of an original equipment vacuum-type extractor, comprising securing to the outside of said extractor a vacuum booster having an air inlet, an air outlet, an electric motor, and a blade rotatable by said motor to move air from said inlet to said outlet of said vacuum booster, connecting said inlet of said vacuum booster to said outlet of said original-equipment extractor, and simultaneously operating said extractor and said motor of said vacuum booster.

* * * * *